United States Patent [19]

Hadley, Jr.

[11] Patent Number: 4,557,053

[45] Date of Patent: Dec. 10, 1985

[54] MUSHROOM SLICER

[76] Inventor: Donald Hadley, Jr., 7671 Derby La., Cotati, Calif. 94928

[21] Appl. No.: 627,412

[22] Filed: Jul. 3, 1984

[51] Int. Cl.[4] ..... B26B 3/00

[52] U.S. Cl. ..... 30/279 R; 30/114; 83/425.2; 83/437; 83/651.1

[58] Field of Search ..... 30/279 R, 114, 117, 30/304, 280; 83/425.2, 425.3, 437, 651.1

[56] References Cited

U.S. PATENT DOCUMENTS 1,478,684 12/1923 Taylor et al. ..... 83/437

2,479,982 8/1949 Stevens ..... 83/437

*Primary Examiner*—Douglas D. Watts

*Attorney, Agent, or Firm*—Owen, Wickersham & Erickson

[57] ABSTRACT

A mushroom slicer. An open-ended cylindrical tube has at least one lengthwise slot therethrough and a rectangular opening spaced from the slot. At one end is a cutter comprising a series of parallel wire passes across the tube adjacent that end. A piston freely movable inside the tube has a handle attached to it and extending out through the slot. In operation, a mushroom is placed via the rectangular opening into the tube between the piston and the cutter. The piston is rapidly moved manually toward the cutter to propel the mushroom through the cutter.

11 Claims, 6 Drawing Figures

MUSHROOM SLICER

BACKGROUND OF THE INVENTION

This invention relates to a slicer for slicing mushrooms, hard-boiled eggs, cooked potatoes, and other foods having a consistency comparable to that of mushrooms.

Heretofore, the slicing of mushrooms has usually been done with a knife, cutting off one slice at at a time. This is less trouble to experienced chefs than it is to most people, because most people are not that adept in the use of the knife. However, whether in the home or in restaurants, the slicing of mushrooms has heretofore taken time, and the general results have not been relatively even slices, but quite irregular ones. I am not aware of other devices that have yielded any substantial improvement, although there have been slicers for hard-boiled eggs that attempted to force the slicer through the egg, usually with poor results.

Among other objects of the invention are those of providing a slicer which can quickly and efficiently slice mushrooms and other similar products; to provide a slicer which can be operated by very unskilled persons to produce very good results; to provide a slicer in which the mushroom or egg is forced through the slicer blades; to provide a mushroom slicer that can be used with either hand; to provide a mushroom slicer that is easily washed after use; and to provide a mushroom slicer that can be constructed inexpensively, and yet do a very professional job.

Other objects and advantages of the invention will appear from the following description, and from the drawings.

SUMMARY OF THE INVENTION

The invention comprises a mushroom slicer, which may also be used to slice eggs, cooked potatoes and beets, and other soft vegetables or fruits.

It comprises an open-ended cylindrical plastic tube having at least one lengthwise slot therethrough, preferably two diametrically opposite such slots. A rectangular or square opening is spaced from the slot, with its longitudinal centerline preferably at about 90° to the slot; when there are two slots, the opening is midway between them.

At one end of the tube is a cutter comprising a series of parallel wire passes across the tube adjacent that end. A single wire may be used to make these passes.

A wooden cylindrical piston is freely movable inside the cylindrical tube. The piston has a radially extending opening leading into it from its peripheral surface, and a metal handle is preferably removably inserted into this opening, normally extending out through the slot in the tube.

A mushroom (or egg, etc.) can be inserted through the rectangular or square opening and placed in the tube between the piston and the cutter. Then, the piston is rapidly moved manually by its handle member toward the cutter, to propel the mushroom through the cutter.

DESCRIPTION OF A PREFERRED EMBODIMENT

Figure 1:
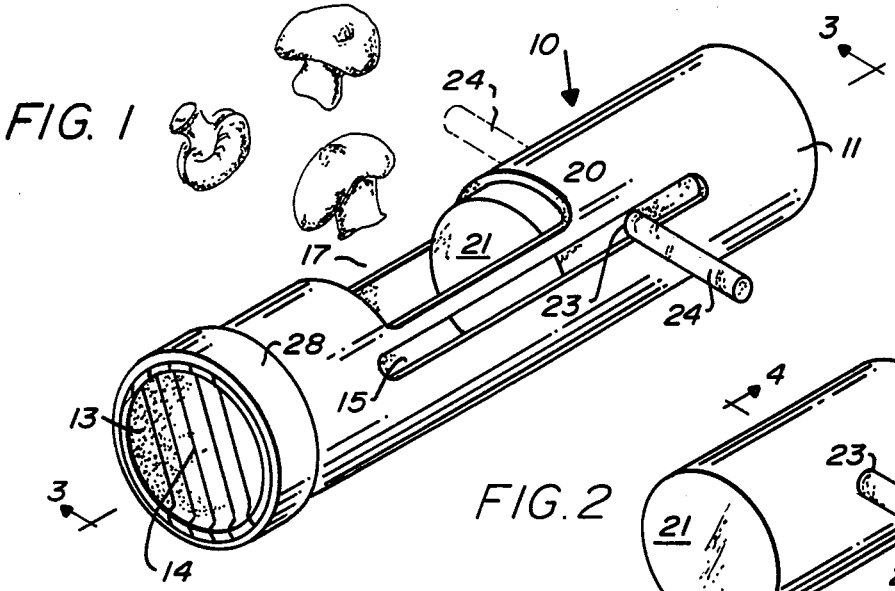
FIG. 1 is a isometric view of a mushroom slicer embodying the principles of the invention. The slicer is shown for operation by the left hand, with a broken line indicating the position of the handle for right hand operation. A few mushrooms are shown ready for insertion into the slicer.
Figure 2:
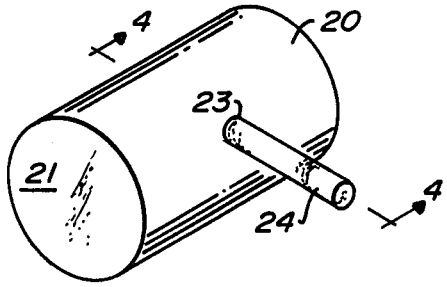
FIG. 2 is a similar view of the piston of the invention shown alone with its handle.
Figure 3:
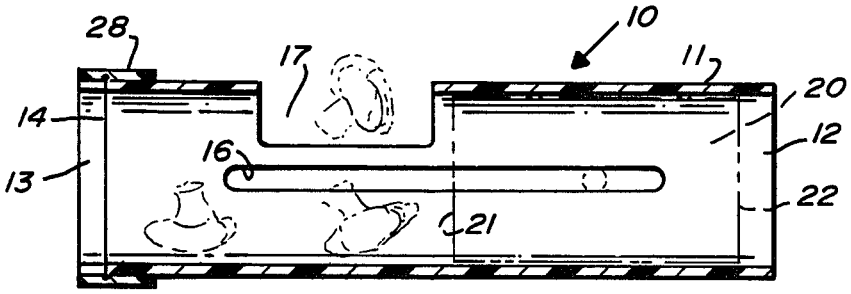
FIG. 3 is a view in section taken along the line 3—3 in FIG. 1. Some of the mushrooms shown in FIG. 1 are here shown in broken lines, and the piston itself and its handle are shown in broken lines so that the parts behind them will be better disclosed.
Figure 4:
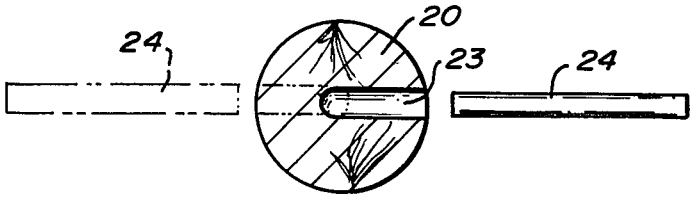
FIG. 4 is a partially exploded view in section taken along the line 4—4 in FIG. 2. The handle is shown detached at the right and is also shown in broken lines at the left in a position for insertion when the piston is inside the cylinder and rotated 180° from the positions shown in FIGS. 1 and 2 and from the position shown in solid lines in FIG. 4.
Figure 6:
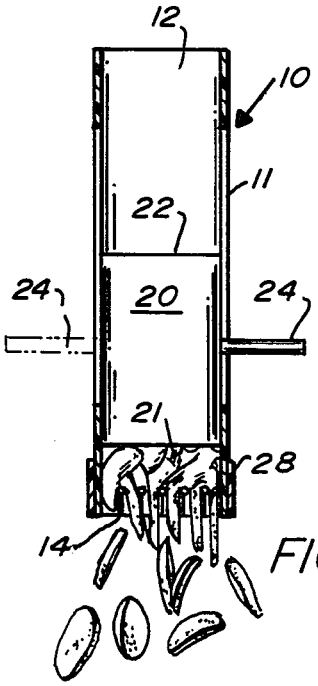
FIG. 6 is a view in elevation of the apparatus, shown from above and on a smaller scale, showing the position of the piston as the mushrooms are pushed through the cutter, with the piston approaching the end of its stroke.

As shown in FIGS. 1 to 4, the mushroom slicer 10 comprises a hollow cylindrical tube 11 open at both ends 12 and 13 with a wire cutting device 14 extending across the end 13. The tube 11 has at least one longitudinally extending slot 15, and preferably has two slots 15 and 16 diametrically opposite each other. The slot 15 is shown in FIG. 1 and the slot 16 in FIG. 3. In between the two slots 15 and 16, if there are two, or at substantially 90° to the single slot 15 if there is only one, is a rectangular opening 17, preferably square and leading transversely into the tube 11.

Inside the tube 11 is a piston 20. The tube 11 is preferably made from plastic, and the piston 20 is preferably made from wood, although other materials may be used. The piston 20 is preferably cylindrical and flat at both ends 21 and 22, and has an opening 23 leading radially in toward the center line of the piston 20. Into this opening 23 is inserted a handle 24, preferably a simple metal rod. It is press fitted there, or in other words, the handle 24 fits snugly into the opening 23 and is readily removable by simply pulling it out. This enables removing the piston 20 for washing, and also enables the piston 20 to be rotated 180° after the handle 24 is removed from the slot 15, and the handle 24 inserted in through the opposite slot 16. Thus, one slot 16 may be preferred for right handed operation, and the other slot 15 for left handed operation. The second position is shown here in broken lines.

Figure 5:
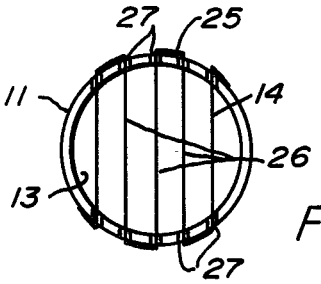
FIG. 5 is a view in end elevation of the tube with the end ring removed to show how a single wire may be used to make the set of parallel wire blades.

The wire cutter 14, as shown in FIGS. 1 and 5, comprises a series of parallel passes 26 spaced equally apart from each other. This may be achieved by using a single wire 25 and by having the tube 11 provided with a series of slits 27 at the end 13 so that the wire 25 can be locked on the outside and then inserted through the far slot 27 and passed around a short portion of the circumference to the next pair of slits, and by going back and forth the single wire 25 achieves the series of parallel wire passage 26. Individual parallel wires may be used, of course, but are generally less desirable. In either event, but especially when a single wire 25 is used, I prefer to have an exterior ring 28 that fits snugly around the cylinder 11, but encloses the ends of the wire passage 26. The ring 28 is preferably cemented to the cylinders 11 so as to be permanently in place, rather than removable.

It will be evident that the device 10 can be washed by simply removing the handle 24, taking out the piston 20, and then the cylinder 11 itself, as well as the piston 24, is ready for thorough washing.

In operation, one or more mushrooms are simply dropped into the rectangular opening 17, with the piston 20 retracted behind it so that the mushrooms lie in between the piston 20 and the cutter 14. When the mushrooms are thus dropped in, the cutter 14 may be held either horizontally or inclined, or if desired, even vertically. The head of the mushroom being heavier than the stem, the mushroom will always fall into a position when inserted in a horizontal tube in which the heads of the mushroom are at the bottom. Then by a rapid, or smart, or quick movement the piston 20 is used to propel the mushrooms through the cutting wires 14. It will be noted that this is different from the types of cutter where an egg or similar object is pushed through a wire. In this instance, the egg, if used in place of the mushroom, would be propelled by the piston 20 to go through the wire 25 instead of having the device pushed through the egg.

As stated, hard boiled eggs, radishes, cooked beets, or cooked new potatoes, or other soft foods that are capable of being sliced and yet are not so hard that they would tend to distort to bend the wire, may be used. The wire itself may be a piano or a guitar type of wire, one which is able to assume a rigid position with some spring in it. This is better than using metal blades or things of that nature.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

What is claimed is:

1. A self-contained, freely movable, easily cleanable mushroom slicer, comprising an open-ended cylindrical tube having at least one lengthwise slot therethrough, a rectangular inlet opening parallel to and spaced from said slot for inserting mushrooms into said slicer, said tube then retaining it in place, cutting means at one open end of said tube comprising a series of parallel wire passes across said tube, adjacent said end, the other end of said tube being fully open, a cylindrical piston inside said cylindrical tube and freely movable inside it, having a radially extending opening leading thereinto from its peripheral surface, and an easily detachable handle fitting in said radially extending opening and extending out from said piston through said slot, whereby a mushroom can be placed in said tube between said piston and said cutting means and said piston rapidly moved manually by its said handle toward said cutting means to propel said mushroom through said cutting means, and whereby said handle can be detached and then said piston withdrawn completely through the fully open end and said handle, piston and tube then being easily cleanable without impediments or catching surfaces except said fully accessible cutting wires.

2. The mushroom slicer of claim 1 having two identical, diametrically opposite lengthwise slots to accommodate said handle on either side of said tube, said rectangular opening being located midway between said slots and spaced from them.

3. The mushroom slicer of claim 2 wherein said handle is removable from said radially extending opening in said piston so that said piston can be rotated 180° and the handle reinserted through the other slot enabling ambidextrous operation.

4. The mushroom slicer of claim 1 wherein the longitudinal centerline of said rectangular opening lies about 90° from that of said slot.

5. The mushroom slicer of claim 1 wherein said series of parallel wire passes comprise a single wire going back and forth across said tube and through parallel slots in the end of the tube.

6. The mushroom slicer of claim 5 having an end ring secured to the outer periphery of said tube at the end having said cutting means, holding in place said wire and covering its portions lying on the outer periphery of said tube.

7. The mushroom slicer of claim 1 wherein said piston is wooden.

8. The mushroom slicer of claim 1 wherein said handle is a metal rod removable from and press fit into said piston.

9. A self-contained, freely movable, easily cleanable mushroom slicer, comprising an open-ended cylindrical plastic tube having a pair of diametrically opposite lengthwise slots therethrough, a square inlet opening spaced in between and equally from said slots and with its longitudinal centerline at about 90° to said slots, for inserting mushrooms into said tube, cutting means at one open end of said tube comprising a series of parallel wire passes across said tube adjacent said end, the other end of said tube being fully open, a wooden cylindrical piston inside said cylindrical tube and freely movable inside it, having a radially extending opening leading thereinto from its peripheral surface, and an easily detachable metal handle member removably inserted into said radially extending opening and normally extending out through one said slot, whereby a mushroom can be placed in said tube between said piston and said cutting means and said piston rapidly moved manually by its said handle member toward said cutting means to propel said mushroom through said cutting means, and whereby said handle can be attached and then said piston withdrawn completely through the fully open end and said handle, piston and tube then being easily cleanable without impediments or catching surfaces except said fully accessible cutting wires.

10. The mushroom slicer of claim 9 wherein said series of parallel wire passes comprise a single wire going back and forth across said tube and through parallel slots in the end of the tube.

11. The mushroom slicer of claim 10 having an end ring secured to the outer periphery of said tube at the end having said cutting means, holding in place said wire and covering its portions lying on the outer periphery of said tube.

* * * * *